US005520028A

United States Patent [19]

Kim et al.

[11] Patent Number: 5,520,028

[45] Date of Patent: May 28, 1996

[54] SELF CLEANING ACTIVATED CARBON FILTER SYSTEM FOR DRY CLEANING MACHINE

[76] Inventors: Eric Kim, 591 Concord Ave., Williston Park, N.Y. 11010; Jong H. Kim, 45 Dennis La., Bethpage, N.Y. 11704

[21] Appl. No.: 340,639

[22] Filed: Nov. 16, 1994

[51] Int. Cl.[6] ..... D06F 39/10

[52] U.S. Cl. ..... 68/18 F; 210/411; 134/111

[58] Field of Search ..... 210/407, 411; 134/166 R, 152, 105, 111, 104.1, 104.2; 68/18 F

[56] References Cited

U.S. PATENT DOCUMENTS

| | | | |
|---|---|---|---|
| 2,495,488 | 1/1950 | Stribling | 68/18 F |
| 2,547,277 | 4/1951 | Marsh et al. | 68/18 F |
| 3,282,073 | 11/1966 | Zehrbach | 68/18 F |
| 3,295,689 | 1/1967 | Arvanitakis | 68/18 F |
| 4,513,590 | 4/1985 | Fine | 68/18 F |
| 4,581,133 | 4/1986 | Tomes | 68/18 F |
| 4,906,357 | 3/1990 | Drori | 210/411 |
| 5,290,437 | 3/1994 | Lin | 210/411 |
| 5,377,707 | 1/1995 | Young, Jr. | 134/104.1 |

FOREIGN PATENT DOCUMENTS

| | | | |
|---|---|---|---|
| 1460376 | 1/1969 | Germany | 68/18 F |

*Primary Examiner*—Frankie L. Stinson
*Attorney, Agent, or Firm*—Michael I. Kroll

[57] ABSTRACT

An activated carbon filter system for a clothes cleaning apparatus of the type using cleaning fluid for cleaning dirty clothes. The system comprises a receptacle unit. A structure is for fluidly connecting the receptacle unit to the clothes cleaning apparatus, so as to allow the cleaning fluid to travel therethrough. A prefilter is within the receptacle unit for separating large contaminant dirt particles from the cleaning fluid during a first state washing cycle. A filter assembly is within the receptacle unit for separating small contaminant dirt particles from the cleaning fluid after the cleaning fluid passes through the prefilter during a second state washing cycle. When placed into a drain cycle, the large contaminant dirt particles on the prefilter and the dirty cleaning fluid can be flushed out from the receptacle unit into a drain tank, allowing the filter assembly to be removed from the receptacle unit, placed into the drain tank to be cleaned out by boiling and then replaced back into the receptacle unit to be used again.

10 Claims, 3 Drawing Sheets

SELF CLEANING ACTIVATED CARBON FILTER SYSTEM FOR DRY CLEANING MACHINE

BACKGROUND OF THE INVENTION

1. Field of the Invention

The instant invention relates generally to filtering devices and more specifically it relates to an activated carbon filter system.

2. Description of the Prior Art

Numerous filtering devices have been provided in prior art that are adapted separate matter from fluids when the fluids pass therethrough. While these units may be suitable for the particular purpose to which they address, they would not be as suitable for the purposes of the present invention as heretofore described.

SUMMARY OF THE INVENTION

A primary object of the present invention is to provide an activated carbon filter system that will overcome the shortcomings of the prior art devices.

Another object is to provide an activated carbon filter system, in which a prefilter will prevent large contaminant dirt particles that was removed from dirty clothes by a cleaning fluid from clogging a filter assembly within a receptacle unit that is fluidly connected to a clothes cleaning apparatus.

An additional object is to provide an activated carbon filter system, in which carbon granules within carbon filter elements in the filter assembly can be reactivated by boiling small contaminant dirt particles out therefrom, so that the carbon filter elements can be used again.

A further object is to provide an activated carbon filter system that is simple and easy to use.

A still further object is to provide an activated carbon filter system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 3:
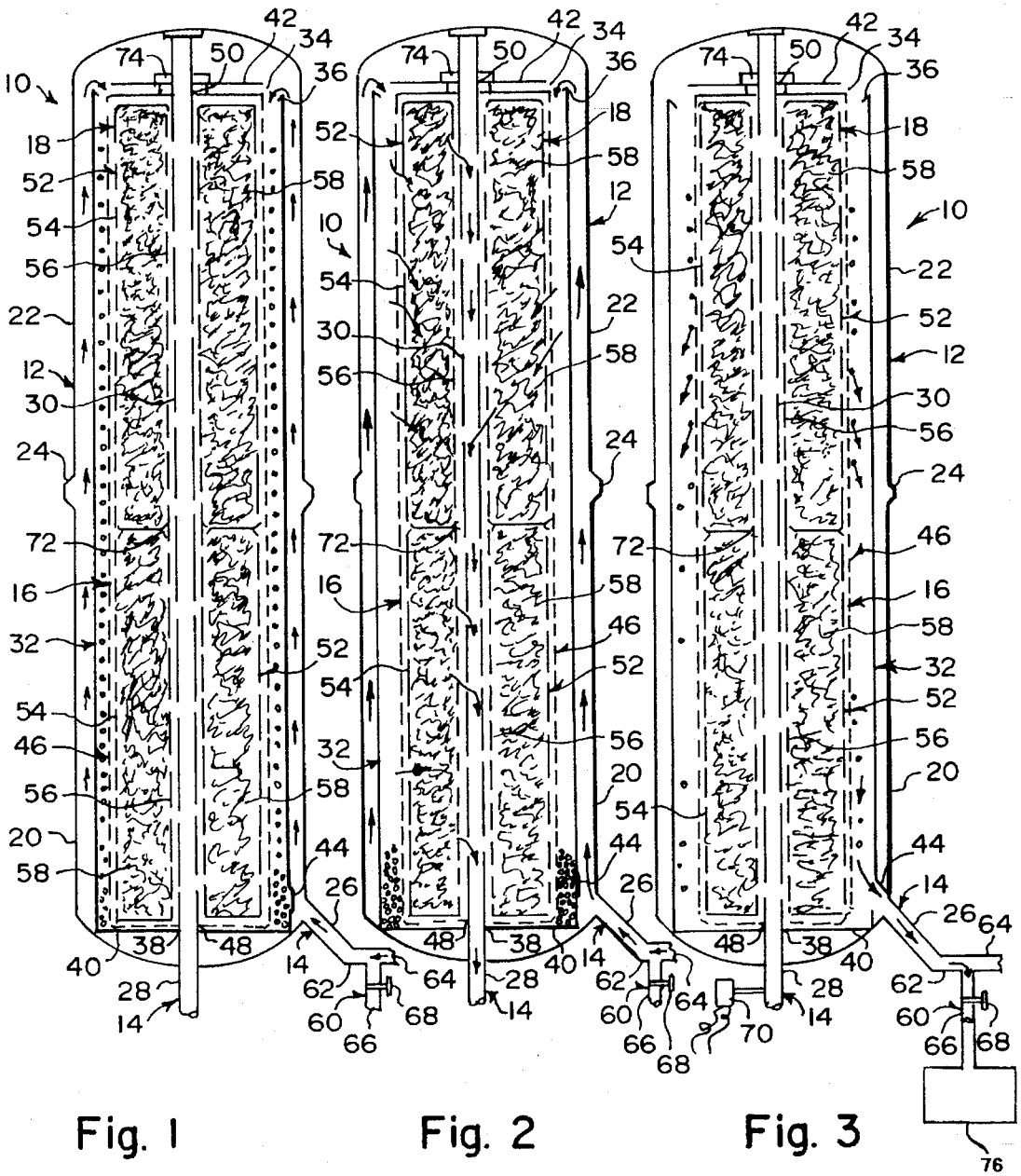
FIG. 1 is a diagrammatic cross sectional view of the instant invention in a first stage washing cycle.
FIG. 2 is a diagrammatic cross sectional view of the instant invention in a second stage washing cycle.
FIG. 3 is a diagrammatic cross sectional view of the instant invention in a drain cycle.

Turning now descriptively to the drawings, in which similar reference characters denote similar elements throughout the several views, FIGS. 1 through 5 illustrate an activated carbon filter system 10 for a clothes cleaning apparatus of the type using cleaning fluid for cleaning dirty clothes. The system 10 comprising a receptacle unit 12. A structure 14 is for fluidly connecting the receptacle unit 12 to the clothes cleaning apparatus, so as to allow the cleaning fluid to travel therethrough. A prefilter 16 within the receptacle unit 12 is for separating large contaminant dirt particles from the cleaning fluid during a first stage washing cycle, as shown in FIG. 1. A filter assembly 18 within the receptacle unit 12 is for separating small contaminant dirt particles from the cleaning fluid, after the cleaning fluid passes through the prefilter 16 during a second stage washing cycle, as shown in FIG. 2. When placed into a drain cycle, as shown in FIG. 3, the large contaminant dirt particles on the prefilter 16 and the dirty cleaning fluid can be flushed out from the receptacle unit 12 into a drain tank 76, allowing the filter assembly 18 to be removed from the receptacle unit 12, placed into the drain tank to be cleaned out by boiling and then replaced back into the receptacle unit 12 to be used again.

The receptacle unit 12 includes a lower housing 20, an upper housing 22 and a clamp joint 24, for securing in a sealed manner the lower housing 20 to the upper housing 22. The fluidly connecting structure 14 consists of a first pipeline 26 affixed to and extending at an angle downwardly from a bottom end of the lower housing 20, so as to allow the cleaning fluid to enter into the lower housing 20. A second pipeline 28 extends centrally into the bottom end of the lower housing 20 and upwardly into the upper housing 22. the second pipeline 28 has a perforated segment 30 within the lower housing 20 and the upper housing 22, so as to allow the cleaning fluid to exit through the lower housing 20.

A cylindrical hollow member 32 is provided, with a diameter slightly smaller than the lower housing 20 and the upper housing 22. when placed within the lower housing 20 and the upper housing 22, there will be a space therebetween for the cleaning fluid to flow up when in the washing cycle. The cylindrical hollow member 32 has a large opening 34 at a top end 36 and a small opening 38 at a bottom end 40. The large opening 34 will allow the prefilter 16 and the filter assembly 18 to enter therethrough. The small opening 38 will allow the perforated segment 30 of the second pipeline 28 to extend upwardly therethrough. A plurality of fins 42 are positioned off center and eccentrically on the top end 36 about the large opening 34. This causes the cleaning fluid coming over the top end 36 and into the large opening 34, to swirl around the prefilter 16 and the filter assembly 18 therein in the washing cycle. A door 44 is hinged to the cylindrical hollow member 32 adjacent the bottom end 40, to allow the cleaning fluid to pass therethrough in the drain cycle.

The prefilter 16 is a fabric bag 46 having a small bottom aperture 48 and a small top aperture 50. The fabric bag 46 can completely cover the filter assembly 18 to separate the large contaminant dirt particles from the cleaning fluid, while allow the second pipeline 28 to pass through the small bottom aperture 4 and out of the small top aperture 50.

The filter assembly 18 includes a pair of active carbon filters 52 that are stacked one upon the other within the fabric bag 46, which is then placed into the cylindrical hollow member 32 over the perforated segment 30 of the second pipeline 28.

Figure 4A:
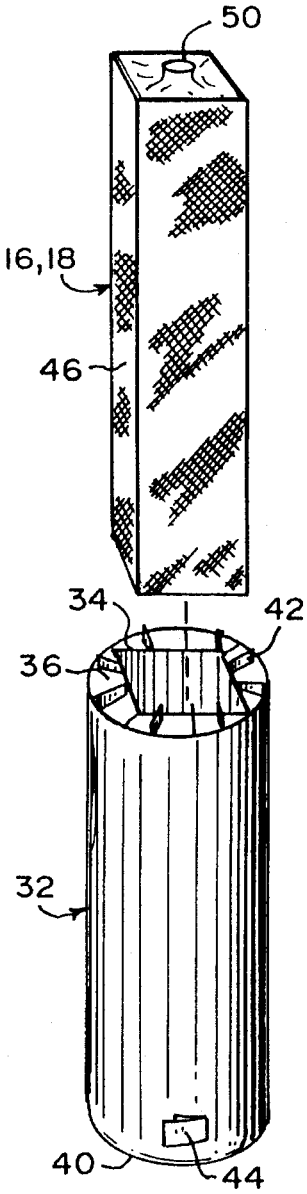
FIG. 4A is an exploded perspective view, showing the filtering assembly removed from the cylinder member.
Figure 4B:
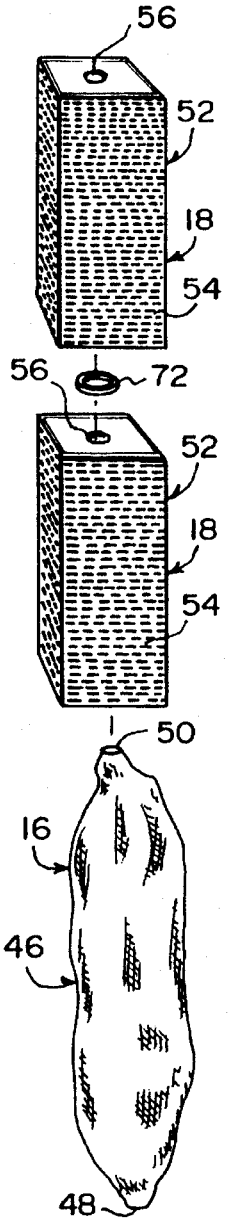
FIG. 4B is an exploded perspective view showing the carbon filter units removed from the prefilter component of the filtering assembly.
Figure 4C:
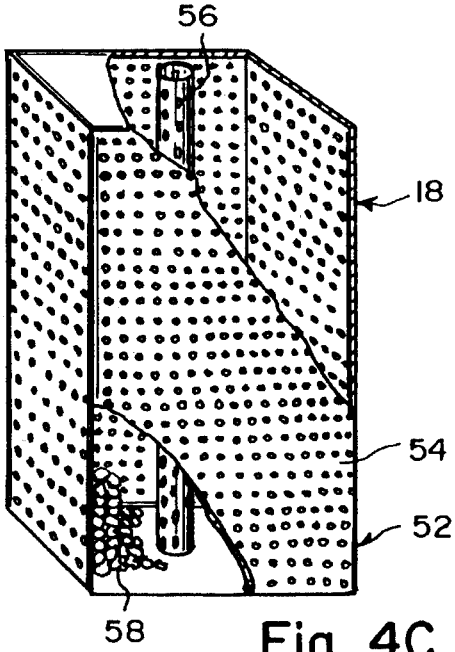
FIG. 4C is an enlarged perspective view with parts broken away of one carbon filter unit.
Figure 5:
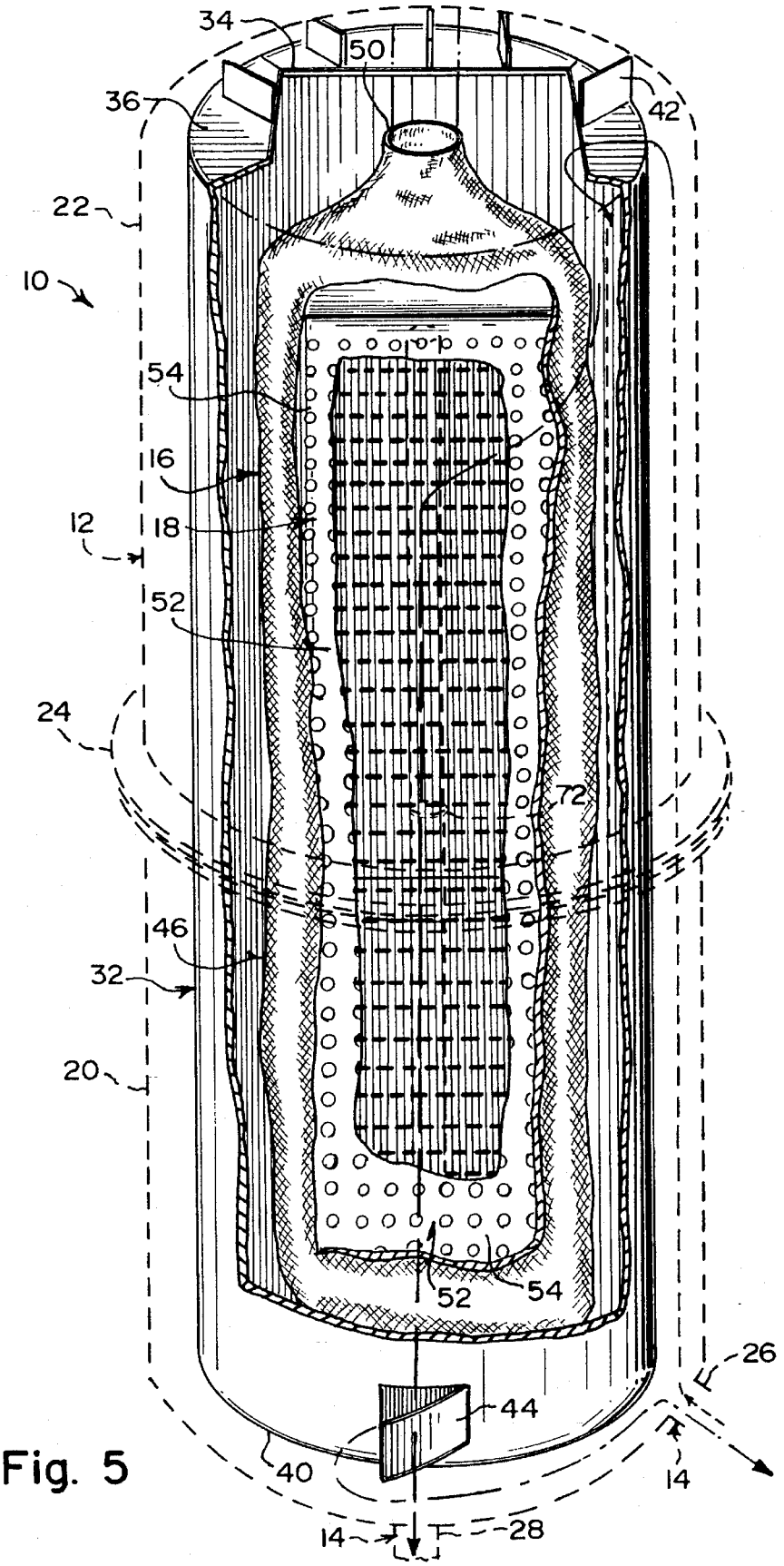
FIG. 5 is a perspective view with parts broken away and in dotted lines of the instant invention, showing the various flow paths of the cleaning fluid therein.

Each active carbon filter as best seen in FIG. 4C, contains a perforated casing 4. A perforated center tube 56 is in the casing, to allow the perforated segment 30 of the second pipeline 28 to pass therethrough. Activated carbon particles 58 are placed within the perforated casing 4 about the perforated center tube 56, so as to separate the small contaminant dirt particles from the cleaning fluid.

A tee fitting 60 has a first end 62 fluidly connected to the first pipeline 26, a second end 64 fluidly connected to the clothes cleaning apparatus, and a third end 66 fluidly connected to the drain tank. a manually operated valve 68 is in the third end 66 of the tee fitting 60, which is closed during the washing cycle and is opened during the drain cycle. An electrically operated valve 70 is in the second pipeline 28, which is automatically opened during the washing cycle and is automatically closed during the drain cycle.

A felt washer 72 is located on the second pipeline 28 between a top end of the perforated center tube 56 of the bottom perforated casing 54 and a bottom end of the perforated center tube 56 of the top perforated casing 54, so as to form a seal therebetween. A clamp 74 is on the second pipeline 28 at the top aperture 50 of the fabric bag 46. The clamp 74 is for securing the pair of active carbon filters 52 in the fabric bag 56 in a stationary position within the cylindrical hollow member 32.

The instant invention will work the same way if positioned horizontally to accomodate certain commercial machines.

LIST OF REFERENCE NUMBERS

10 activated carbon filter system
12 receptacle unit
14 fluidly connecting structure
16 prefilter
18 filter assembly
20 lower housing of 12
22 upper housing of 12
24 clamp joint
26 first pipeline
28 second pipeline
30 perforated segment of 28
32 cylindrical hollow member
34 large opening
36 top end of 32
38 small opening
40 bottom end of 32
42 fin
44 door on 32
46 fabric bag for 16
48 small bottom aperture in 46
50 small top aperture in 46
52 active carbon filter of 18
54 perforated casing of 52
56 perforated center tub in 54
58 activated carbon particles in 54
60 tee fitting
62 first end of 60
64 second end of 60
66 third end of 60
68 manually operated valve in 66
70 electrically operated valve in 28
72 felt washer on 28
74 clamp on 28

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An activated carbon filter system for a clothes cleaning apparatus of the type using cleaning fluid for cleaning dirty clothes, said system comprising:

a) a receptacle unit;

b) means for fluidly connecting said receptacle unit to the clothes cleaning apparatus, so as to allow the cleaning fluid to travel therethrough;

c) a prefilter within said receptacle unit for separating large contaminant dirt particles from the cleaning fluid during a first stage washing cycle; and d) a filter assembly within said receptacle unit for separating small contaminant dirt particles from the cleaning fluid after the cleaning fluid passes through said prefilter during a second stage washing cycle, so that when placed into a drain cycle the large contaminant dirt particles on said prefilter and the dirty cleaning fluid can be flushed out from said receptacle unit into a drain tank, allowing said filter assembly to be removed from said receptacle unit, placed into the drain tank to be cleaned out by boiling and then replaced back into said receptacle unit to be used again.

2. An activated carbon filter system as recited in claim 1, wherein said receptacle unit includes:

a) a lower housing;

b) an upper housing; and c) a clamp joint for securing in a sealed manner said lower housing to said upper housing.

3. An activated carbon filter system as recited in claim 2, wherein said fluidly connecting means includes:

a) a first pipeline affixed to and extending at an angle downwardly from a bottom end of said lower housing, so as to allow the cleaning fluid to enter into said lower housing; and b) a second pipeline extending centrally into the bottom end of said lower housing and upwardly into said upper housing, said second pipeline having a perforated segment within said lower housing and said upper housing, so as to allow the cleaning fluid to exit through said lower housing.

4. An activated carbon filter system as recited in claim 3, further including:

a) a cylindrical hollow member with a diameter slightly smaller than said lower housing and said upper housing, so that when placed within said lower housing and said upper housing, there will be a space therebetween for the cleaning fluid to flow up when in the washing cycle, said cylindrical hollow member having a large opening at a top end and a small opening at a bottom end, whereby said large opening will allow said prefilter and said filter assembly to enter therethrough, while said small opening will allow said perforated segment of said second pipeline to extend upwardly therethrough;

b) a plurality of fins positioned off center and eccentrically on said top end about said large opening, so as to cause the cleaning fluid coming over said top end and into said large opening, to swirl around said prefilter and said filter assembly therein in the washing cycle; and c) a door hinged to said cylindrical hollow member adjacent said bottom end, to allow the cleaning fluid to pass therethrough in the drain cycle.

5. An activated carbon filter system as recited in claim 4, wherein said prefilter is a fabric bag having a small bottom aperture and a small top aperture, whereby said fabric bag can completely cover said filter assembly to separate the large contaminant dirt particles from the cleaning fluid, while allowing said second pipeline to pass through said small bottom aperture and out of said small top aperture.

6. An activated carbon filter system as recited in claim 5, wherein said filter assembly includes a pair of active carbon filters that are stacked one upon the other within said fabric bag, which is then placed into said cylindrical hollow member over said perforated segment of said second pipeline.

7. An activated carbon filter system as recited in claim 6, wherein each said active carbon filter includes:

a) a perforated casing;

b) a perforated center tube in said casing to allow said perforated segment of said second pipeline to pass therethrough; and c) activated carbon particles placed within said perforated casing about said perforated center tube, so as to separate the small contaminant dirt particles from the cleaning fluid.

8. An activated carbon filter system as recited in claim 7, further including:

a) a tee fitting having a first end fluidly connected to said first pipeline, a second end fluidly connected to the clothes cleaning apparatus, and a third end fluidly connected to the drain tank;

b) a manually operated valve in said third end of said tee fitting, which is closed during the washing cycle and is opened during the drain cycle; and c) an electrically operated valve in said second pipeline, which is automatically opened during the washing cycle and is closed during the drain cycle.

9. An activated carbon filter system as recited in claim 8, further including a felt washer located on said second pipeline between a top end of said perforated center tube of said bottom perforated casing and a bottom end of said perforated center tube of said top perforated casing, so as to form a seal therebetween.

10. An activated carbon filter system as recited in claim 9, further including a clamp on said second pipeline at said top aperture of said fabric bag, for securing said pair of active carbon filters in said fabric bag in a stationary position within said cylindrical hollow member.

* * * * *